US006290548B1

(12) United States Patent
Yeh

(10) Patent No.: US 6,290,548 B1
(45) Date of Patent: Sep. 18, 2001

(54) CABLE CONNECTOR

(76) Inventor: Jeff Yeh, No. 11, Lane 369, Tatung Rd, Hsi-Chin Chen, Taipei-Hsien (TW)

( * ) Notice: Subject to any disclaimer, the term of this patent is extended or adjusted under 35 U.S.C. 154(b) by 0 days.

(21) Appl. No.: 09/628,238

(22) Filed: Jul. 28, 2000

(30) Foreign Application Priority Data

Nov. 2, 1999 (TW) ..... 88218609 U

(51) Int. Cl.[7] ..... H01R 13/502
(52) U.S. Cl. ..... 439/701; 439/686; 439/607
(58) Field of Search ..... 439/701, 607, 439/609, 610, 608, 695, 686, 752, 752.5, 108

(56) References Cited

U.S. PATENT DOCUMENTS 3,492,631 * 1/1970 Olsson ..... 439/701
5,580,283 * 12/1996 O'Sullivan et al. ..... 439/686
5,667,411 * 9/1997 O'Sullivan et al. ..... 439/701
5,695,366 * 12/1997 Tomczak et al. ..... 439/607
5,722,861 * 3/1998 Wetter ..... 439/701
5,975,917 * 11/1999 Wang et al. ..... 439/79
6,093,061 * 7/2000 Varsik et al. ..... 439/701
6,171,134 * 1/2001 Lai ..... 439/405

* cited by examiner

*Primary Examiner*—Gary F. Paumen
*Assistant Examiner*—Ross Gushi
(74) *Attorney, Agent, or Firm*—Pro-Techtor International Services

(57) ABSTRACT

A cable connector comprises a cable-end connector having first pins each including a flat plate and a first and second front engagement strips wherein both strips are extended from plate with a small elevational gap therebetween, and two first slopes each attached between one strip and plate; and an equipment-end connector having second pins each including a first and second front engagement pieces wherein both pieces are extended forward to form a small gap therebetween, two second slopes each attached between one piece and the second pin, and two third slopes each formed on the tip of piece. One strip is abutted on top of one piece, while the other strip is abutted on bottom of the other piece by inserting first pin in second pin wherein pieces are further extended to abut on top and bottom of plate. This causes a compressed elastic force exerted on first pin by second pin and vice versa, resulting in a secured engagement of first and second pins.

6 Claims, 5 Drawing Sheets

CABLE CONNECTOR

FIELD OF THE INVENTION

The present invention relates to cable connectors.

BACKGROUND OF THE INVENTION

A conventional cable connector is shown in FIGS. 1 and 2. In FIG. 1, pin assembly A comprises a plurality of plate members C1 each having a number of pins C disposed lengthwise. Pins C of plate member C1 are inserted into holes B1 of plastic body B wherein a tab C12 of one plate member C1 is engaged with a recess C11 of adjacent plate member C1 and other tabs C12, C13, and C14 of plate members C1 are engaged with slots B2, B3, and B4 of plastic body B. Further, insertion of plate members C1 is done by one by one, i.e., sequentially. This completes an assembled connector as shown in FIG. 2.

But this is unsatisfactory for the purpose for which the invention is concerned for the following reasons:

1. Such one by one insertion of plate members C1 is tedious. Also, components tend to be messy in installation.

2. The engagement between tabs of plate members C1 and slots of plastic body B is weak. As such, a relatively large force exerted on pin assembly A may cause it to separate from plastic body B.

SUMMARY OF THE INVENTION

It is thus an object of the present invention to provide an cable connector comprising a cable-end connector having a plurality of first pins each including a flat plate, a first front engagement strip, a second front engagement strip wherein both front engagement strips are extended from plate with a small elevational gap therebetween, and two first slopes each attached between one front engagement strip and plate; and an equipment-end connector having a plurality of second pins each including a first front engagement piece, a second front engagement piece wherein both front engagement pieces are extended forward to form a small gap therebetween, two second slopes each attached between one front engagement piece and the second pin, and two third slopes each formed on the tip of front engagement piece. One front engagement strip is abutted on top of one front engagement piece, while the other front engagement strip is abutted on bottom of the other front engagement piece by inserting first pin in second pin wherein front engagement pieces are further extended to abut on top and bottom of plate. This causes a compressed elastic force exerted on first pin by second pin and vice versa, resulting in a secured engagement of first and second pins.

It is another object of the present invention to provide an cable connector comprising a plastic body consisting of a front and rear walls and a pin assembly in a stacked configuration wherein the assembled pin assembly is inserted in front wall of plastic body, rear wall is mounted to front wall, and a housing is snapped onto the assembled plastic body and pin assembly to form a complete connector. Such configuration ensures a secure engagement of pin assembly in the connector.

The above and other objects, features and advantages of the present invention will become apparent from the following detailed description taken with the accompanying drawings.

DETAILED DESCRIPTION OF THE PREFERRED EMBODIMENTS

Figure 3:
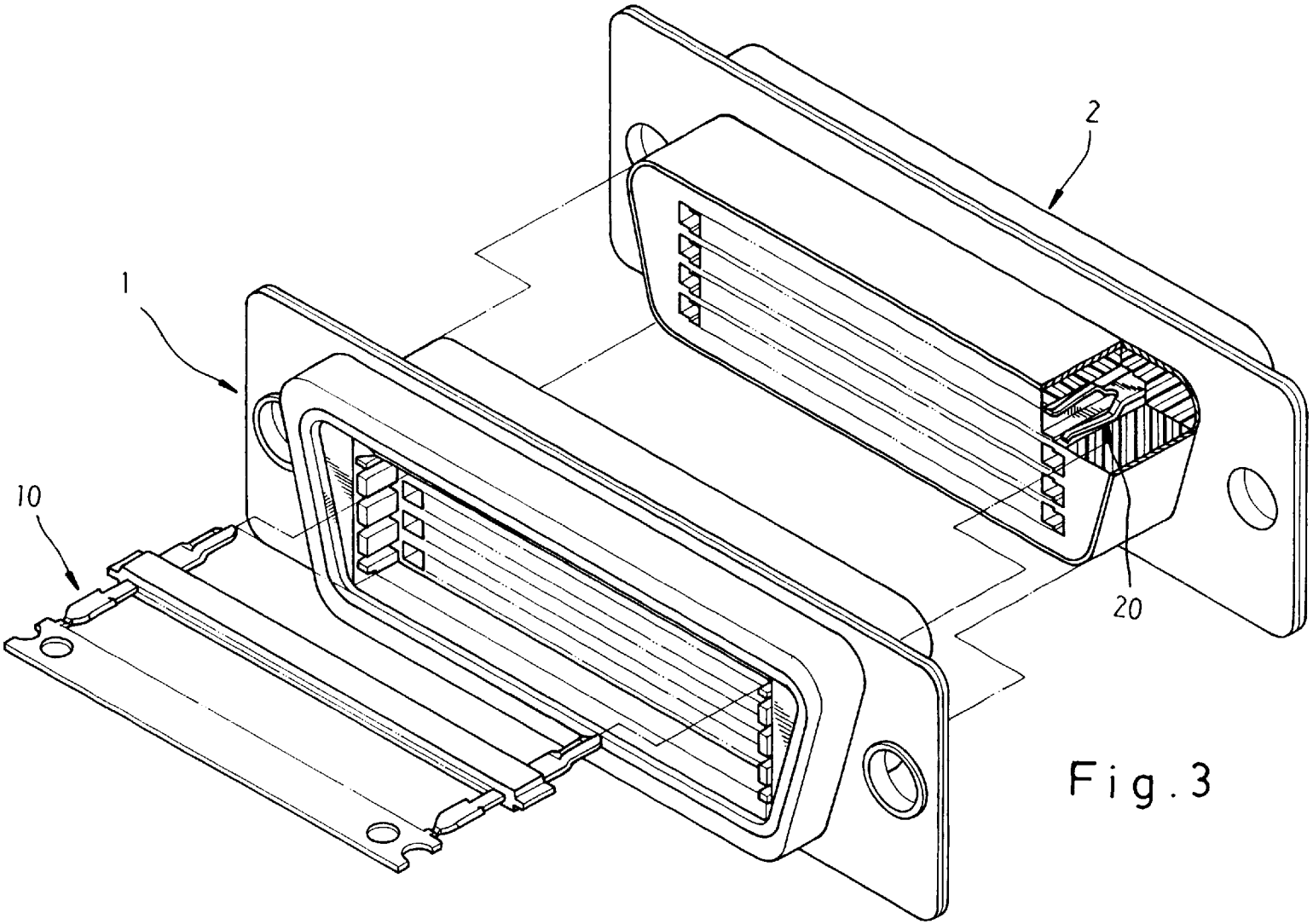
FIG. 3 is an exploded view of a preferred embodiment of cable-end connector and equipment-end connector of cable connector according to the invention.

Referring to FIG. 3, there is shown an cable connector constructed in accordance with the invention comprising a cable-end connector 1 attached to cable and an equipment-end connector 2 attached to, for example an interface connector of computer wherein cable-end connector 1 and equipment-end connector 2 have a plurality of pins 10 and 20 received therein respectively. As such, signals may transmit from cable-end connector 1 to equipment-end connector 2 and vice versa when cable-end connector 1 and equipment-end connector 2 are assembled.

Figure 4:
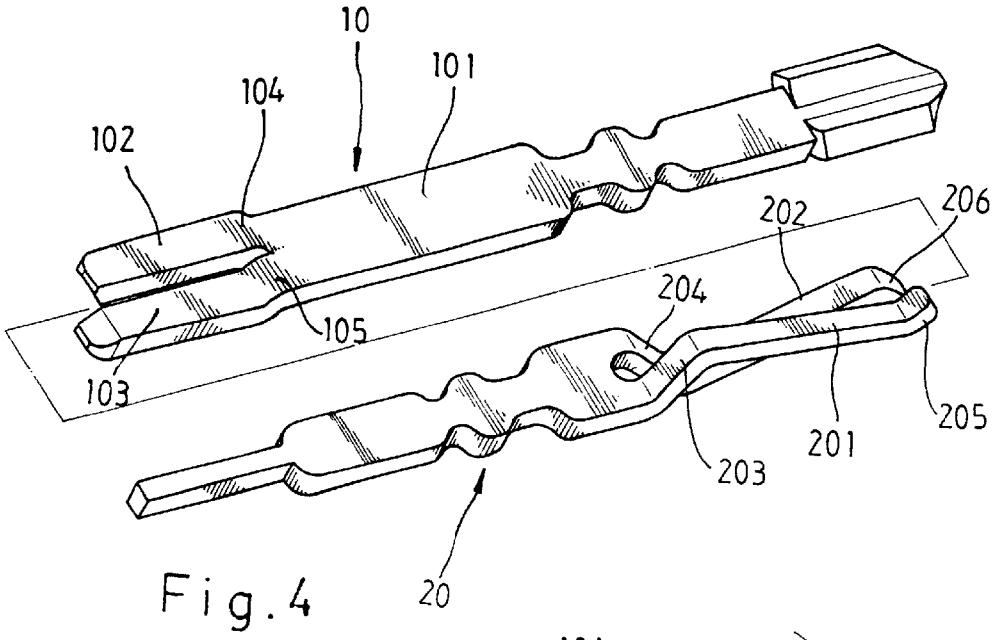
FIG. 4 is a perspective view of pins of cable-end connector and equipment-end connector shown in FIG. 3.

Referring to FIG. 4, each pin 10 of cable-end connector 1 comprises a flat plate 101, a first front engagement strip 102, and a second front engagement strip 103 wherein both front engagement strips 102 and 103 are extended from plate 101 with a small elevational gap therebetween. Slope 104 and 105 are attached between front engagement strip 102 and plate 101 and between front engagement strip 103 and plate 101 respectively. Similarly, in an opposite orientation, front portion of each pin 20 of equipment-end connector 2 comprises a first front engagement piece 201 and a second front engagement piece 202 wherein both front engagement pieces 201 and 202 are extended forward to form a small gap therebetween. Slopes 203 and 204 are attached between front engagement piece 201 and pin 20 and between front engagement piece 202 and pin 20 respectively. Further, slopes 205 and 206 generally having the same orientations as slopes 203 and 204 are formed on the tips of front engagement pieces 201 and 202 respectively. Such guided slopes 205 and 206 are preferred because they can facilitate the engagements of pins 10 and 20 as detailed below.

Figure 5:
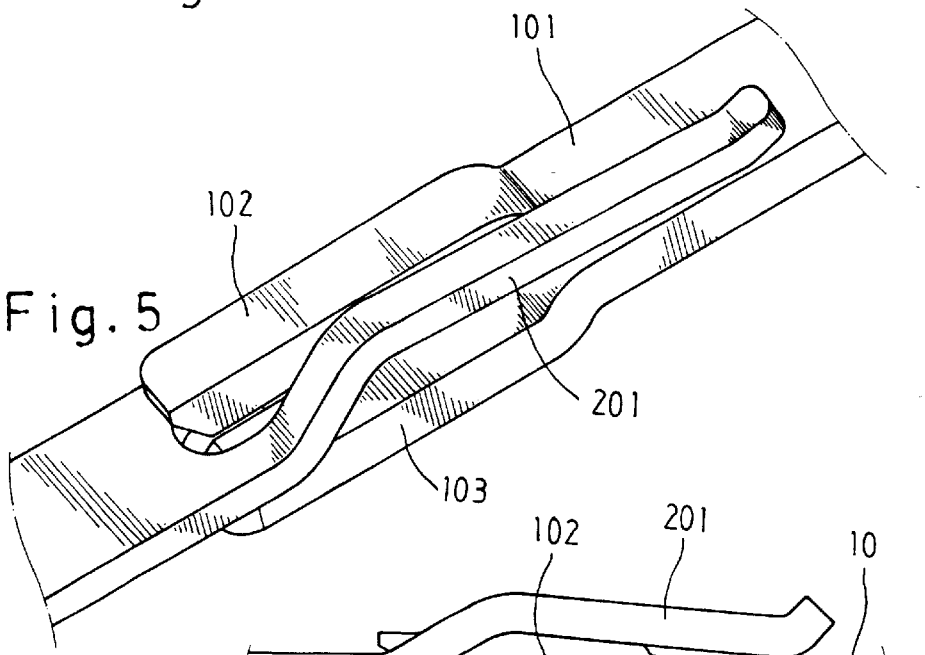
FIG. 5 is a fragmentary perspective view of assembled pins of cable-end connector and equipment-end connector of FIG. 4.
Figure 6:
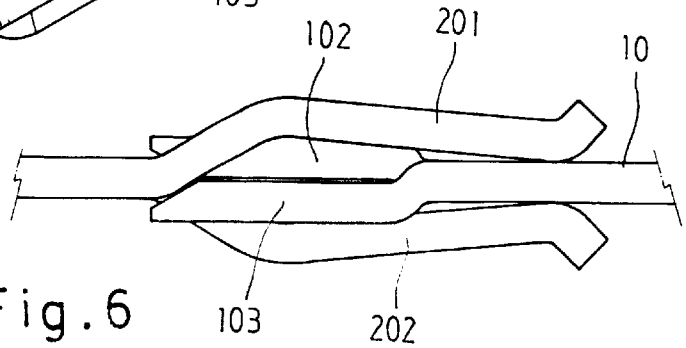
FIG. 6 is a sectional view of FIG. 5.

Referring to FIGS. 5 and 6, the engagement of pins 10 and 20 is illustrated. As shown, front engagement strip 102 is abutted on top of front engagement piece 202, while front engagement strip 103 is abutted on bottom of front engagement piece 201 by inserting pin 10 in pin 20 wherein front engagement pieces 201 and 202 are further extended to abut on top and bottom of plate 101. It is understood that there is a compressed elastic force exerted on pin 10 by pin 20 and vice versa. As such, the engagement is secured.

Figures 1, 8:
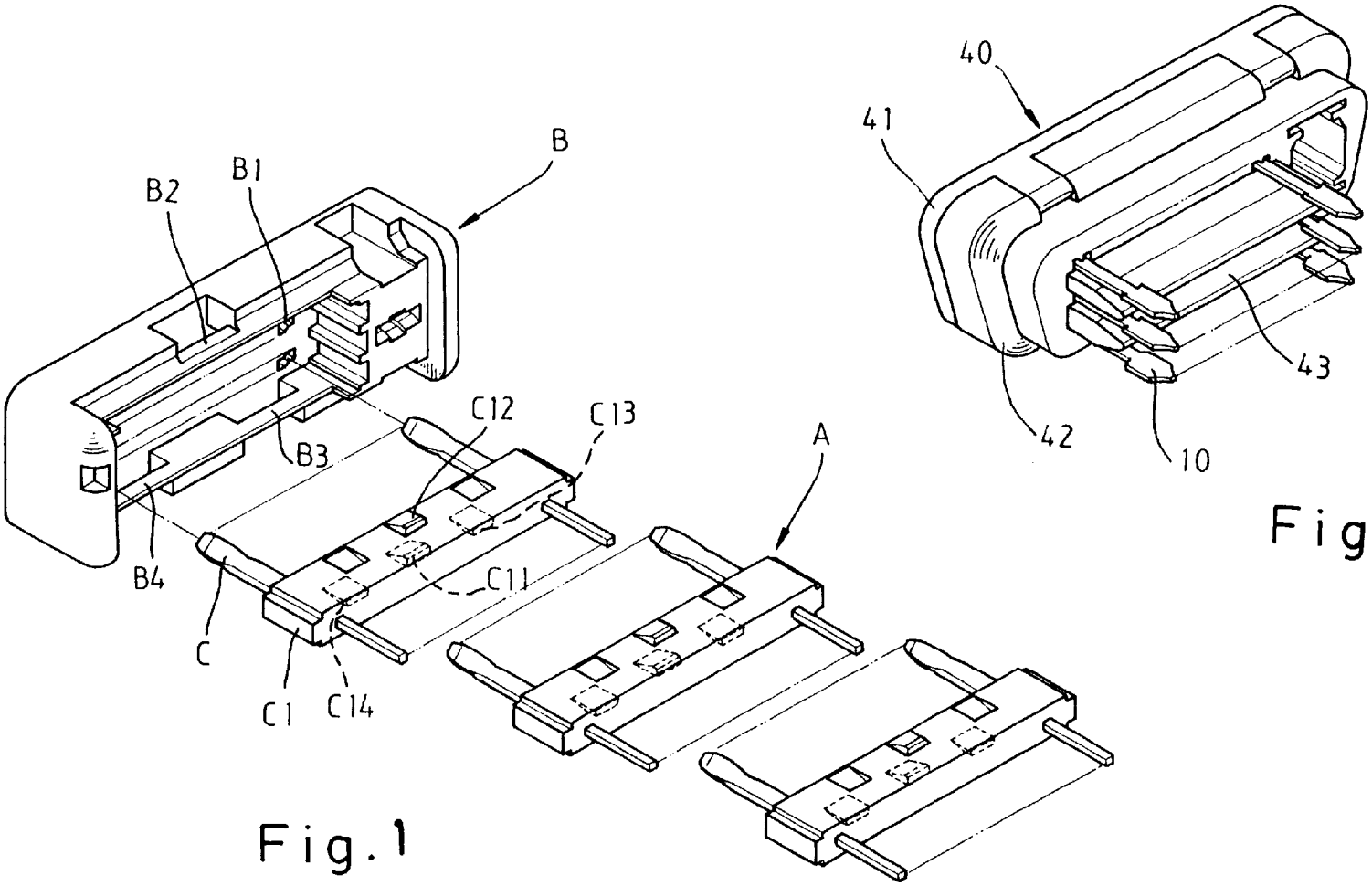
Fig. 1 PRIOR Art.
FIG. 1 is an exploded view of a conventional cable connector.
FIG. 8 is a perspective view of assembled plastic body and pin assembly of FIG. 7.
Figure 9:
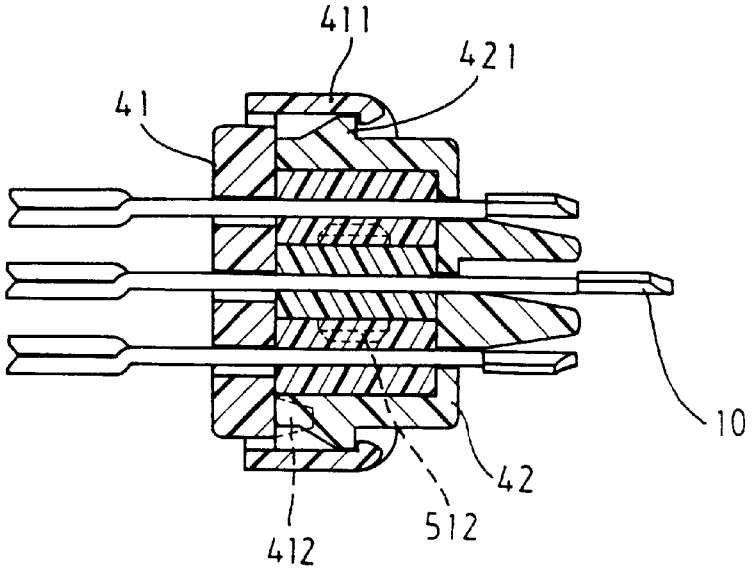
FIG. 9 is a sectional view of FIG. 8.
Figure 2:
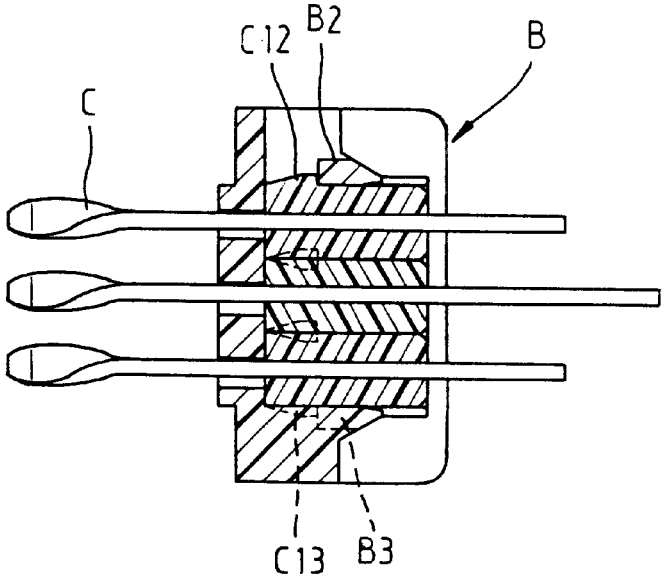
Fig. 2 PRIOR Art.
FIG. 2 is sectional view of assembled cable connector of FIG. 1.
Figure 7:
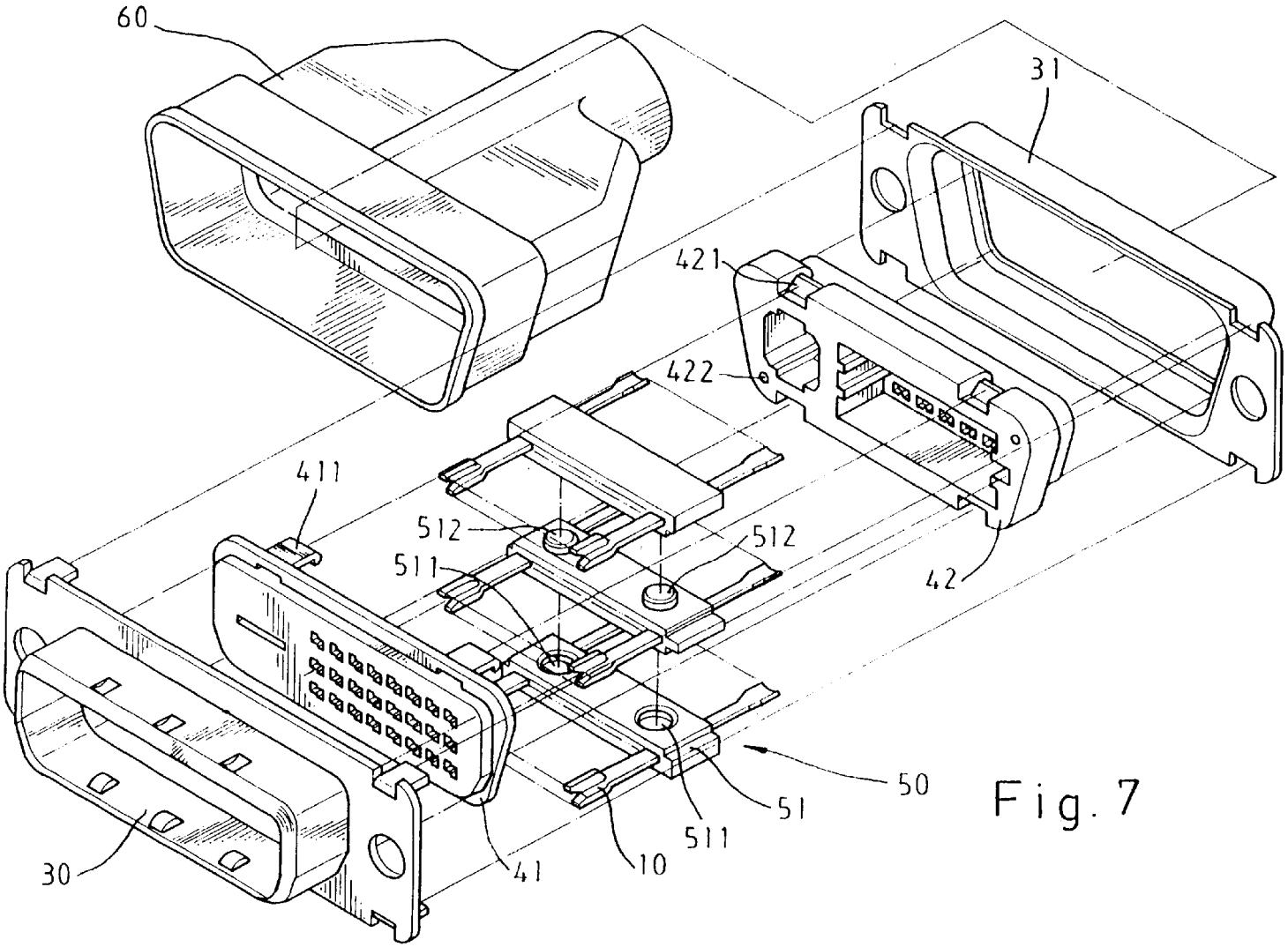
FIG. 7 is an exploded view of cable connector according to the invention.

Referring to FIG. 7, this is further exploded view of connector of FIG. 3 plus a housing 60. As shown, connector further comprises an anti-interference upper and lower frames 30 and 31, a plastic body 40 consisting of front and rear walls 41 and 42, and a pin assembly 50 in a stacked configuration. Note that the assembled connector is enclosed by housing 60. Pin assembly 50 includes a plurality of plate members 51 each having a number of pins 10 disposed in a row. As shown, each plate member 51 has two projections 512 on top surface and two holes 511 on bottom surface. As such, projections 512 of one plate member 51 can engage with holes 511 of another plate member 51 in assembling the pin assembly 50. Further, insert the assembled pin assembly 50 in front wall 41 of plastic body 40. Then mount rear wall 42 to front wall 41. A complete connector without housing 60 is shown in FIGS. 8 and 9. As shown in FIG. 9, tabs 411 and projections 412 of front wall 41 are engaged with latched members 421 and holes 422 of rear wall 42 respectively. Such configuration ensures a secure engagement of pin assembly 50 in the connector. Further, the rear wall 42 of plastic body 40 has a plurality of separation plates 43 each disposed between two adjacent rows of protruded pins 10. Separation plate 43 acts as an electrical insulation member between two adjacent rows of pins 10. As a result, a potential short circuit of pins 10 is avoided.

While the invention herein disclosed has been described by means of specific embodiments, numerous modifications and variations could be made thereto by those skilled in the art without departing from the scope and spirit of the invention set forth in the claims.

What is claimed is:

1. A cable connector combination comprising:

a cable-end connecting means including an upper and a lower anti-interference frames, a plastic body including a front and a rear walls, and a plate assembly including a plurality of parallel spaced plate members each having a plurality of first pins, each of said first pins having first pin ends in one side, a plurality of second pin ends in the other opposed side electrically connected to the first pin ends, a plurality of projections on the top, and a plurality of holes on the bottom wherein the projections of one plate member are engaged with the holes of the other adjacent plate member;

an equipment-end connecting means; and a housing;

wherein one side of the plate assembly is inserted in the front wall of the plastic body, the other side of the plate assembly is inserted in the rear wall of the plastic body, and the assembled plate assembly and the plastic body is enclosed by the housing.

2. The cable connector of claim 1, wherein the front wall of plastic body includes a plurality of tabs and a plurality of protrusions the rear wall of plastic body includes a plurality of latched members and holes being secured to the tabs and the protrusions respectively.

3. The cable connector of claim 1, wherein the rear wall of the plastic body has a plurality of electrically insulated separation plates each disposed between two adjacent plate members.

4. The cable connector of claim 1, wherein each of the first pins includes a flat plate, a first front engagement strip, a second front engagement strip wherein the front engagement strips are extended from the flat plate with a small elevational gap therebetween, and two first slopes each attached between one of the front engagement strips and the flat plate.

5. The cable connector of claim 4, wherein said equipment end connecting means comprises second pins, each of the second pins includes a first front engagement piece, a second front engagement piece spaced from the first front engagement piece, and two second slopes each attached between one of the front engagement piece and the second pin wherein the first front engagement piece is abutted on the top of the second front engagement strip and the second front engagement piece is abutted on the top of the first front engagement strip.

6. The cable connector of claim 5, wherein each of the second front engagement pieces includes a third guided slope having the same orientation as the second front engagement piece on the tip of the front engagement piece.

* * * * *